US011180827B2

(12) United States Patent
Dou et al.

(10) Patent No.: US 11,180,827 B2
(45) Date of Patent: Nov. 23, 2021

(54) METHOD FOR PREPARING FERROVANADIUM ALLOYS BASED ON ALUMINOTHERMIC SELF-PROPAGATING GRADIENT REDUCTION AND SLAG WASHING REFINING

(71) Applicant: NORTHEASTERN UNIVERSITY, Shenyang (CN)

(72) Inventors: Zhihe Dou, Shenyang (CN); Tingan Zhang, Shenyang (CN); Yan Liu, Shenyang (CN); Guozhi Lv, Shenyang (CN); Qiuyue Zhao, Shenyang (CN); Liping Niu, Shenyang (CN); Daxue Fu, Shenyang (CN); Weiguang Zhang, Shenyang (CN)

(73) Assignee: Northeastern University, Shenyang (CN)

( * ) Notice: Subject to any disclaimer, the term of this patent is extended or adjusted under 35 U.S.C. 154(b) by 106 days.

(21) Appl. No.: 16/621,064

(22) PCT Filed: May 21, 2018

(86) PCT No.: PCT/CN2018/087685
§ 371 (c)(1),
(2) Date: Dec. 10, 2019

(87) PCT Pub. No.: WO2018/228139
PCT Pub. Date: Dec. 20, 2018

(65) Prior Publication Data

US 2020/0199712 A1 Jun. 25, 2020

(30) Foreign Application Priority Data

Jun. 13, 2017 (CN) ..... 201710443500.6

(51) Int. Cl.

| | |
|---|---|
| ***C22C 1/03*** | (2006.01) |
| ***C22B 1/00*** | (2006.01) |
| ***C22C 1/06*** | (2006.01) |
| ***C22C 27/02*** | (2006.01) |
| ***C22C 33/06*** | (2006.01) |
| ***C22C 35/00*** | (2006.01) |
| ***C22C 38/12*** | (2006.01) |

(52) U.S. Cl.
CPC ..... *C22C 1/03* (2013.01); *C22B 1/005* (2013.01); *C22C 1/06* (2013.01); *C22C 27/025* (2013.01); *C22C 33/06* (2013.01); *C22C 35/005* (2013.01); *C22C 38/12* (2013.01)

(58) Field of Classification Search
CPC ..... C22C 27/025; C22C 1/00
See application file for complete search history.

(56) References Cited

U.S. PATENT DOCUMENTS 5,152,830 A * 10/1992 Kobayashi ..... C21B 15/02 75/414

FOREIGN PATENT DOCUMENTS

| | | | | |
|---|---|---|---|---|
| CN | 103031484 | A | * | 4/2013 |
| CN | 103031484 | A | | 4/2013 |
| CN | 104120304 | A | | 10/2014 |
| CN | 104131128 | A | | 11/2014 |
| CN | 104131178 | A | | 11/2014 |
| CN | 106191639 | A | * | 12/2016 |
| CN | 106191639 | A | | 12/2016 |
| CN | 107099696 | A | | 8/2017 |
| CN | 107099715 | A | | 8/2017 |
| CN | 107099718 | A | | 8/2017 |
| RU | 2485194 | C1 | | 6/2013 |
| RU | 2506338 | C1 | | 2/2014 |

OTHER PUBLICATIONS

CN 103031484 A English Machine Translation (Year: 2013).*
CN 106191639 A English Machine Translation (Year: 2016).*

* cited by examiner

*Primary Examiner* — Kiley S Stoner
*Assistant Examiner* — Catherine P Smith
(74) *Attorney, Agent, or Firm* — Muncy, Geissler, Olds & Lowe, P.C.

(57) ABSTRACT

The present invention provides a method for preparing ferrovanadium alloys based on aluminothermic self-propagating gradient reduction and slag washing refining. The method includes the steps of (1) performing aluminothermic self-propagating gradient reduction; (2) performing heat preserving and smelting to obtain an upper layer alumina-based slag and a lower layer alloy melt; (3) jetting refining slags into the lower layer alloy melt, and performing stirring and slag washing refining; and (4) cooling the refined high-temperature melt to room temperature, and removing an upper layer smelting slag to obtain the ferrovanadium alloys.

7 Claims, No Drawings

METHOD FOR PREPARING FERROVANADIUM ALLOYS BASED ON ALUMINOTHERMIC SELF-PROPAGATING GRADIENT REDUCTION AND SLAG WASHING REFINING

BACKGROUND OF THE INVENTION

1. Field of the Invention

The invention relates to a method for preparing ferrovanadium alloys, in particular to a method for preparing ferrovanadium alloys based on aluminothermic self-propagating gradient reduction and slag washing refining.

2. The Prior Arts

Ferrovanadium is one of important ferroalloys in iron and steel industry and is mainly used as an alloy additive for steel making. After ferrovanadium is added into steel, the hardness, strength, abrasive resistance and ductility of the steel can be significantly improved, and the machinability of the steel can be improved. Ferrovanadium is usually used for production of carbon steel, low-alloy high-strength steel, high-alloy steel, tool steel and cast iron. Currently, common ferrovanadium comprises three kinds of common ferrovanadium containing 40%, 60% and 80% of vanadium respectively. The main smelting methods of ferrovanadium mainly include an electro-silicothermic process and a traditional extra-furnace thermite process. In the electro-silicothermic process, qualified products can be prepared from flake vanadium pentoxide as a main raw material and 75% ferrosilicon and a little aluminium as reducing agents through two stages of reduction and refining in a basic electric arc furnace. Furnace slag produced in the later stage of refining in this process is called as rich slag (containing up to 8-12% of $V_2O_5$). This process is mainly used for smelting ferrovanadium containing 40-60% of vanadium. In the silicothermic process, aluminium is used as a reducing agent, and a bottom igniting method is adopted for smelting in a drum with a basic lining. Firstly, a small portion of mixed furnace burden is fed into a reactor, and then the furnace is ignited. After the reaction starts, the rest furnace burden is added sequentially. This process is usually used for smelting high-vanadium iron (containing 60-80% of vanadium). This process causes low vanadium recovery rate being about 90-95%. China Patent (CN103031484A) discloses a method for smelting ferrovanadium, which takes quick lime, aluminium, iron and vanadium oxide as raw materials. The recovery rate of vanadium is increased by controlling the ingredients fed, but problems that in the reaction process, the slag-metal separation is incomplete, and the content of inclusions in the alloy is high, exist. In accordance with the defects that for a conventional method for preparing ferrovanadium, in the reaction process, the recovery rate of vanadium is low, slag-metal separation effect is poor, content of inclusions in the alloy is high, and pollution is high, the invention provides a method for preparing ferrovanadium alloys based on aluminothermic self-propagating gradient feeding reduction and slag washing refining.

SUMMARY OF THE INVENTION

In accordance with the problems existing in the prior art, the invention provides a method for preparing ferrovanadium alloys based on aluminothermic self-propagating gradient reduction and slag washing refining. The method comprises the following steps of: using vanadium oxide, $Fe_2O_3$, and the like. as starting materials, performing gradient feeding, performing aluminothermic self-propagating reaction to obtain high-temperature melt, adding refining slags with high basicity into the high-temperature melt to adjust the basicity and the melting point of the slag, performing slag washing refining, and finally removing the slag to obtain the ferrovanadium.

The method for preparing ferrovanadium alloys based on aluminothermic self-propagating gradient reduction and slag washing refining adopts the technical scheme that the method comprises the following steps:

(1) Performing the aluminothermic self-propagating gradient reduction in one of the following two manners:

The first manner: dividing raw materials of vanadium oxide, $Fe_2O_3$ powder, aluminium powder and a slag former into many batches, pouring a first batch of the raw materials into a reaction furnace, performing igniting with magnesium powder from a top of the raw materials to initiate an aluminothermic self-propagating reaction, and sequentially adding other batches of the raw materials till complete reaction to obtain a high-temperature melt, wherein an aluminium proportioning amount of each batch of the raw materials is gradiently reduced from 1.15-1.35 times to 0.85-0.65 times of a theoretical stoichiometric ratio of the aluminothermic self-propagating reaction, and a total aluminium proportioning amount of the raw materials is 0.94-1.00 times of the theoretical stoichiometric ratio of the aluminothermic self-propagating reaction;

The second manner: uniformly mixing raw materials of the vanadium oxide, the $Fe_2O_3$ powder and the slag former to obtain a mixture, adding the mixture into a continuous mixer at an even velocity, adding the aluminium powder into the continuous mixer at a gradiently decreased velocity at the same time, and continuously introducing a uniformly mixed materials into the reaction furnace for the aluminothermic self-propagating reaction, wherein an entire material mixing process and an entire reaction process are performed continuously until all materials react completely to obtain the high-temperature melt, The aluminium proportioning amount of the continuous raw materials introduced into the reaction furnace is gradiently reduced from 1.15-1.35 times to 0.85-0.65 of the theoretical stoichiometric ratio of the aluminothermic self-propagating reaction, the number n of gradient changes of the aluminium proportioning amount in the entire process satisfies a relational expression: $n=(b-c)/a$, b represents a highest aluminium proportioning amount, c represents a lowest aluminium proportioning amount, a represents a gradient change coefficient of the aluminium proportioning amount, and a is greater than 0, and smaller than or equal to 0.04, and the total aluminium proportioning amount of the raw materials is 0.94-1.00 times of the theoretical stoichiometric ratio of the aluminothermic self-propagating reaction;

(2) Performing heat preserving and smelting on the high-temperature melt through electromagnetic induction heating to obtain an upper layer alumina-based slag and a lower layer alloy melt;

(3) Jetting refining slags into the lower layer alloy melt, and performing stirring and slag washing refining; and (4) Cooling the refined high-temperature melt to room temperature, and removing an upper layer smelting slag to obtain the ferrovanadium alloy.

Further, a mass ratio of the raw materials of the vanadium oxide to the $Fe_2O_3$ powder to the aluminium powder to the slag former is 1.0:(0.2-1.49):(0.56-1.00):(0.82-1.95), and particle sizes thereof respectively meet the following conditions: a particle size of the vanadium oxide is smaller than or equal to 5 mm, a particle size of the $Fe_2O_3$ is smaller than or equal to 0.2 mm, a particle size of the aluminium powder is smaller than or equal to 5 mm, and a particle size of the slag former is smaller than or equal to 0.2 mm.

Furthermore, the vanadium oxide is $V_2O_5$ or $V_2O_3$.

Furthermore, a number of the batches in the step (1) is greater than or equal to 4.

Furthermore, a weight of the first batch of the raw materials in the step (1) is 10-30% of that of total materials.

Furthermore, control parameters of the heat preserving and smelting in the step (2) are as follows: an electromagnetic induction frequency is greater than or equal to 1000 Hz, a smelting temperature is 1700-1800° C., and a heat preserving time is 5-15 min.

Furthermore, the refining slags in the step (3) are one of the following two types: (1) 10-25% of $CaF_2$ and a balance of CaO by mass; (2) 10-25% of $CaF_2$, 5-10% of $Na_2O$ and a balance of CaO by mass.

Furthermore, the control parameters of the stirring and slag washing refining in the step (3) are as follows: an eccentric stirring is adopted, with an eccentricity ratio of 0.2-0.4, an addition amount of refining slags is 2-8% of total raw materials, inert gas with purity being greater than or equal to 99.95% is used as carrier gas, a stirring speed is 50-150 rpm, a refining temperature is 1700-1800° C., and a refining time is 10-30 min.

Furthermore, the ferrovanadium alloys comprise the following chemical components in percentages by mass: 35.0-80.0% of V, Al being smaller than or equal to 1.5%, Si being smaller than or equal to 1.0%, O being smaller than or equal to 1.0% and a balance of Fe.

The present invention has the following beneficial effects that:

1. The first batch of the materials being higher in aluminium proportioning factors than a theoretical stoichiometric ratio of the aluminothermic self-propagating reaction are subjected to aluminothermic self-propagating reaction to obtain high-temperature melt with higher temperature, which is beneficial for initiating the reaction of subsequent materials with low aluminium proportioning factors; besides, aluminium proportioning factors being greater in former period and later period can guarantee that the melt is in strong reducing atmosphere so as to guarantee thorough reduction of metal oxides; besides, in the manner of feeding by gradually reducing the aluminium proportioning factors, aluminium combined with iron in the melt and remained in the alloys is gradually released, and gradually reacts with oxides of titanium and vanadium in the subsequently-added materials with low aluminium proportioning factors, and aluminium remaining content in final products is effectively reduced; and the more the feeding batch or the smaller the gradient of the continuous aluminium proportioning factors is, the lower the aluminium residue is.

2. Through stirring and slag washing refining, the alkalinity and the melting point of the slags are adjusted with added refining slags, slag-metal interfacial chemical reaction and thorough slag-metal separation are realized, and impurities such as aluminium oxide, are effectively removed; and besides, the reaction heat of a system is fully utilized in the heat insulation and melting process, so that energy consumption in the production process can be greatly reduced. In addition, electromagnetic heating is adopted for heat preserving and smelting to form an upper layer alumina-based slag and a lower layer alloy melt prior to stirring and slag washing refining, so that the slag-melt separation process can be effectively enhanced.

3. The ferrovanadium alloys obtained in the present invention comprises the following chemical components in percentages by mass: 35.0-80.0% of V, Al being smaller than or equal to 1.5%, Si being greater than or equal to 1.0%, O being greater than or equal to 1.0%, and the balance of Fe, wherein the recovery rate of vanadium is high, and the residual amounts of aluminium and oxygen are low.

DETAILED DESCRIPTION OF THE PREFERRED EMBODIMENT

In the description of the prevent invention, it should be noted that the conventional conditions or the conditions recommended by manufacturers shall prevail in the embodiment that no specific conditions are specified in the embodiments. Manufacturers of used reagents or instruments are not specified, and commercially available conventional products shall be used.

The present invention will be further detailed below in combination with embodiments. The description of the present invention is not intended to be limitation.

Embodiment 1

The method for preparing ferrovanadium alloys based on aluminothermic self-propagating gradient reduction and slag washing refining comprises the following steps:

(1) Aluminothermic self-propagating gradient reduction

Preparing the raw materials in mass ratio of the raw materials of $V_2O_5$, $Fe_2O_3$ powder, aluminium powder and a slag former CaO being 1.0 to 0.8 to 0.76 to 0.99, wherein the particle size meets the condition that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; dividing the materials into 5 batches, wherein the aluminium proportioning amount of each batch of the materials is gradually 1.20, 1.05, 1.00, 0.90 and 0.85 time of the theoretical stoichiometric ratio of the aluminothermic self-propagating reaction, the total aluminium proportioning amount of the raw materials is 0.98 times of the theoretical stoichiometric ratio of the aluminothermic self-propagating reaction, and the weight of the first batch of the materials is 20% of that of the total materials; adding the first batch of the materials to a reaction furnace, pouring the first batch of materials into the reaction furnace, performing igniting with magnesium powder from the top of the materials to initiate the self-propagating reaction, and sequentially adding other batches of the materials till complete reaction to obtain high-temperature melt;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1800° C., and the heat preserving time is 15 min;

(3) Removing 90% of upper-layer aluminium oxide based melt slags, jetting refining slags into the lower layer alloy melt, and performing stirring and slag washing refining, wherein the refining slags consist of the components in mass ratio of 10% of $CaF_2$ and 90% of CaO, and the control parameters are as follows: the addition amount of the refining slags is 2% of total raw materials, argon gas with purity being greater than or equal to 99.95°% is used as carrier gas, the eccentric stirring speed is 50 rpm, the eccentric rate is 0.23, the refining temperature is 1800° C., and the refining time is 10 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 49.1% of V, 0.2% of Si, 0.8% of Al, 0.6% of O, and the balance of Fe.

Embodiment 2

The method for preparing ferrovanadium alloys based on aluminothermic self-propagating gradient reduction and slag washing refining comprises the following steps:

(1) Aluminothermic self-propagating gradient reduction

Preparing the raw materials in mass ratio of the raw materials of $V_2O_5$, $Fe_2O_3$ powder, aluminium powder and a slag former CaO being 1.0 to 0.94 to 0.79 to 1.15, wherein the particle size meets the condition that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the article size of the slag former is smaller than or equal to 0.2 mm; dividing the materials into 6 batches, wherein the aluminium proportioning amount of each batch of the materials is gradually 1.20, 1.10, 0.95, 0.90, 0.85 and 0.80 times of the theoretical stoichiometric ratio of the aluminothermic self-propagating reaction, the total aluminium proportioning amount of the raw materials is 0.98 times of the theoretical stoichiometric ratio of the aluminothermic self-propagating reaction, and the weight of the first batch of the materials is 28.6% of that of the total materials; adding the first batch of the materials to a reaction furnace, pouring the first batch of materials into the reaction furnace, performing igniting with magnesium powder from the top of the materials to initiate the self-propagating reaction, and sequentially adding other batches of the materials till complete reaction to obtain high-temperature melt;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1750° C., and the heat preserving time is 10 min;

(3) Removing 90% of upper-layer aluminium oxide based melt slags, jetting refining slags into the lower layer alloy melt, and performing stirring and slag washing refining, wherein the refining slags consist of the components in mass ratio of 20% of $CaF_2$ and 80% of CaO, and the control parameters are as follows: the addition amount of the refining slags is 5% of total raw materials, argon gas with purity being greater than or equal to 99.95% is used as carrier gas, the eccentric stirring speed is 100 rpm, the eccentric rate is 0.28, the refining temperature is 1750° C., and the refining time is 20 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 48.7% of V, 0.4% of Si, 0.7% of Al, 0.6% of O, and the balance of Fe.

Embodiment 3

The method for preparing ferrovanadium alloys based on aluminothermic self-propagating gradient reduction and slag washing refining specially comprises the following steps:

(1) Aluminothermic self-propagating gradient reduction

Preparing the raw materials in mass ratio of the raw materials of $V_2O_3$, $Fe_2O_3$ powder, aluminium powder and a slag former CaO being 1.0 to 1.06 to 0.84 to 1.54, wherein the particle size meets that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; dividing the materials into 8 batches, wherein the aluminium proportioning amount of each batch of the materials is gradually 1.20, 1.1, 1.0, 0.95, 0.925, 0.90, 0.875 and 0.85 time of the theoretical stoichiometric ratio of the aluminothermic self-propagating reaction, the total aluminium proportioning amount of the raw materials is 0.98 times of the theoretical stoichiometric ratio of the aluminothermic self-propagating reaction, and the weight of the first batch of the materials is 22.2% of that of the total materials; adding the first batch of the materials to a reaction furnace, pouring the first batch of materials into the reaction furnace, performing igniting with magnesium powder from the top of the materials to initiate the self-propagating reaction, and sequentially adding other batches of the materials till complete reaction to obtain high-temperature melt;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1700° C., and the heat preserving time is 5 min;

(3) Removing 90% of upper-layer aluminium oxide based melt slags, jetting refining slags into the lower layer alloy melt, and performing stirring and slag washing refining, wherein the refining slags consist of the components in mass ratio of 25% of $CaF_2$ and 75% of CaO, and the control parameters are as follows: the addition amount of the refining slags is 7% of total raw materials, argon gas with purity being greater than or equal to 99.95% is used as carrier gas, the eccentric stirring speed is 150 rpm, the eccentric rate is 0.4, the refining temperature is 1700° C., and the refining time is 30 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 47.0% of V, 0.2% of Si, 0.41% of Al, 0.45% of O, and the balance of Fe.

Embodiment 4

The method for preparing ferrovanadium alloys based on aluminothermic self-propagating gradient reduction and slag washing refining specially comprises the following steps:

(1) Aluminothermic self-propagating gradient reduction

Preparing the raw materials in mass ratio of the raw materials of $V_2O_3$, $Fe_2O_3$ powder, aluminium powder and a slag former CaO being 1.0 to 1.24 to 0.86 to 1.62, wherein the particle size meets that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; uniformly mixing the raw materials of the $V_2O_3$, the $Fe_2O_3$ powder and the slag former to obtain a mixture, adding the mixture into a continuous mixer at an even velocity, adding the aluminium powder into the continuous mixer at a gradiently decreased velocity at the same time, and continuously introducing the uniformly mixed materials into the reaction furnace for the aluminothermic self-propagating reaction, wherein the entire material mixing process and the entire reaction process are performed continuously until all materials react completely to obtain the high-temperature melt, the aluminium proportioning amount of continuous materials introduced into the reaction furnace is gradiently reduced from 1.3 times to 0.68 times of the theoretical stoichiometric ratio of the aluminothermic self-propagating reaction, the number a of gradient changes is 0.004, the number of gradient changes of the aluminium proportioning amount in the entire process is 155 times, and the total aluminium proportioning amount of the raw materials is 0.98 times of the theoretical stoichiometric ratio of the aluminothermic self-propagating reaction;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1750° C., and the heat preserving time is 10 min;

(3) Removing 90% of upper-layer aluminium oxide based melt slags, jetting refining slags into the lower layer alloy melt, and performing stirring and slag washing refining, wherein the refining slags consist of the components in mass ratio of 10% of $CaF_2$, 85% of CaO and 5% of $Na_2O$, and the control parameters are as follows: the addition amount of the refining slags is 5% of total raw materials, argon gas with purity being greater than or equal to 99.95% is used as carrier gas, the eccentric stirring speed is 100 rpm, the eccentric rate is 0.2, the refining temperature is 1750° C., and the refining time is 20 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 42.5% of V, 0.6% of Si, 0.70% of Al, 0.56% of O, and the balance of Fe.

Embodiment 5

The method for preparing ferrovanadium alloys based on aluminothermic self-propagating gradient reduction and slag washing refining specially comprises the following steps:

(1) Aluminothermic self-propagating gradient reduction

Preparing the raw materials in mass ratio of the raw materials of $V_2O_5$, $Fe_2O_3$ powder, aluminium powder and a slag former CaO being 1.0 to 1.37 to 0.89 to 1.71, wherein the particle size meets that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; uniformly mixing the raw materials of the $V_2O_5$, the $Fe_2O_3$ powder and the slag former to obtain a mixture, adding the mixture into a continuous mixer at an even velocity, adding the aluminium powder into the continuous mixer at a gradiently decreased velocity at the same time, and continuously introducing the uniformly mixed materials into the reaction furnace for the aluminothermic self-propagating reaction, wherein the entire material mixing process and the entire reaction process are performed continuously until all materials react completely to obtain the high-temperature melt, the aluminium proportioning amount of continuous materials introduced into the reaction furnace is gradiently reduced from 1.26 times to 0.7 times of the theoretical stoichiometric ratio of the aluminothermic self-propagating reaction, the number a of gradient changes is 0.002, the number of gradient changes of the aluminium proportioning amount in the entire process is 280 times, and the total aluminium proportioning amount of the raw materials is 0.96 times of the theoretical stoichiometric ratio of the aluminothermic self-propagating reaction;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1700° C., and the heat preserving time is 10 min;

(3) Removing 90% of upper-layer aluminium oxide based melt slags, jetting refining slags into the lower layer alloy melt, and performing stirring and slag washing refining, wherein the refining slags consist of the components in mass ratio of 10% of $CaF_2$, 80% of CaO and 10% of $Na_2O$, and the control parameters are as follows: the addition amount of the refining slags is 4% of total raw materials, argon gas with purity being greater than or equal to 99.95% is used as carrier gas, the eccentric stirring speed is 100 rpm, the eccentric rate is 0.3, the refining temperature is 1700° C., and the refining time is 20 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 40.6% of V, 0.7% of Si, 0.65% of Al, 0.54% of O, and the balance of Fe.

Embodiment 6

The method for preparing ferrovanadium alloys based on aluminothermic self-propagating gradient reduction and slag washing refining specially comprises the following steps:

(1) Aluminothermic self-propagating gradient reduction

Preparing the raw materials in mass ratio of the raw materials of $V_2O_5$, $Fe_2O_3$ powder, aluminium powder and a slag former CaO being 1.0 to 1.39 to 0.92 to 1.54, wherein the particle size meets that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; uniformly mixing the raw materials of the $V_2O_5$, the $Fe_2O_3$ powder and the slag former to obtain a mixture, adding the mixture into a continuous mixer at an even velocity, adding the aluminium powder into the continuous mixer at a gradiently decreased velocity at the same time, and continuously introducing the uniformly mixed materials into the reaction furnace for the aluminothermic self-propagating reaction, wherein the entire material mixing process and the entire reaction process are performed continuously until all materials react completely to obtain the high-temperature melt, the aluminium proportioning amount of continuous materials introduced into the reaction furnace is gradiently reduced from 1.26 times to 0.68 times of the theoretical stoichiometric ratio of the aluminothermic self-propagating reaction, the number a of gradient changes is 0.001, the number of gradient changes of the aluminium proportioning amount in the entire process is 580 times, and the total aluminium proportioning amount of the raw materials is 0.94 times of the theoretical stoichiometric ratio of the aluminothermic self-propagating reaction;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1700° C., and the heat preserving time is 15 min;

(3) Removing 90% of upper-layer aluminium oxide based melt slags, jetting refining slags into the lower layer alloy melt, and performing stirring and slag washing refining, wherein the refining slags consist of the components in mass ratio of 20% of $CaF_2$, 75% of CaO and 5% of $Na_2O$, and the control parameters are as follows: the addition amount of the refining slags is 8% of total raw materials, argon gas with purity being greater than or equal to 99.95% is used as carrier gas, the eccentric stirring speed is 100 rpm, the eccentric rate is 0.4, the refining temperature is 1700° C., and the refining time is 30 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 38.6% of V, 0.6% of Si, 0.36% of Al, 0.31% of O, and the balance of Fe.

Embodiment 7

The method for preparing ferrovanadium alloys based on aluminothermic self-propagating gradient reduction and slag washing refining specially comprises the following steps:

(1) Aluminothermic self-propagating gradient reduction

Preparing the raw materials in mass ratio of the raw materials of $V_2O_5$, $Fe_2O_3$ powder, aluminium powder and a slag former CaO being 1.0 to 0.43 to 0.64 to 0.85, wherein the particle size meets that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; dividing the materials into 5 batches, wherein the aluminium proportioning amount of each batch of the materials is gradually 1.20, 1.05, 1.0, 0.90 and 0.85 time of the theoretical stoichiometric ratio of the aluminothermic self-propagating reaction, the total aluminium proportioning amount of the raw materials is 0.97 times of the theoretical stoichiometric ratio of the aluminothermic self-propagating reaction, and the weight of the first batch of the materials is 20% of that of the total materials; adding the first batch of the materials to a reaction furnace, pouring the first batch of materials into the reaction furnace, performing igniting with magnesium powder from the top of the materials to initiate the self-propagating reaction, and sequentially adding other batches of the materials till complete reaction to obtain high-temperature melt;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1800° C., and the heat preserving time is 15 min;

(3) Removing 90% of upper-layer aluminium oxide based melt slags, jetting refining slags into the lower layer alloy melt, and performing stirring and slag washing refining, wherein the refining slags consist of the components in mass ratio of 10% of $CaF_2$ and 90% of CaO, and the control parameters are as follows: the addition amount of the refining slags is 2% of total raw materials, argon gas with purity being greater than or equal to 99.95% is used as carrier gas, the eccentric stirring speed is 50 rpm, the eccentric rate is 0.32, the refining temperature is 1800° C., and the refining time is 10 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 64.2% of V, 0.1% of Si, 0.72% of Al, 0.57% of O, and the balance of Fe.

Embodiment 8

The method for preparing ferrovanadium alloys based on aluminothermic self-propagating gradient reduction and slag washing refining specially comprises the following steps:

(1) Aluminothermic self-propagating gradient reduction

Preparing the raw materials in mass ratio of the raw materials of $V_2O_5$, $Fe_2O_3$ powder, aluminium powder and a slag former CaO being 1.0 to 0.49 to 0.66 to 0.91, wherein the particle size meets that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; dividing the materials into 6 batches, wherein the aluminium proportioning amount of each batch of the materials is gradually 1.20, 1.1, 0.95, 0.90, 0.85 and 0.80 time of the theoretical stoichiometric ratio of the aluminothermic self-propagating reaction, the total aluminium proportioning amount of the raw materials is 0.96 times of the theoretical stoichiometric ratio of the aluminothermic self-propagating reaction, and the weight of the first batch of the materials is 28.6% of that of the total materials; adding the first batch of the materials to a reaction furnace, pouring the first batch of materials into the reaction furnace, performing igniting with magnesium powder from the top of the materials to initiate the self-propagating reaction, and sequentially adding other batches of the materials till complete reaction to obtain high-temperature melt;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1750° C., and the heat preserving time is 10 min;

(3) Removing 90% of upper-layer aluminium oxide based melt slags, jetting refining slags into the lower layer alloy melt, and performing stirring and slag washing refining, wherein the refining slags consist of the components in mass ratio of 20% of $CaF_2$ and 80% of CaO, and the control parameters are as follows: the addition amount of the refining slags is 5% of total raw materials, argon gas with purity being greater than or equal to 99.95% is used as carrier gas, the eccentric stirring speed is 100 rpm, the eccentric rate is 0.35, the refining temperature is 1750° C., and the refining time is 20 min; and (4) Cooling the refined high-temperature melt to room temperature, and removing the upper layer smelting slag to obtain the ferrovanadium alloys.

Furthermore, the prepared ferrovanadium alloys in the embodiment consists of the following chemical components in percentages by mass: 63.9% of V, 0.4% of Si, 0.63% of Al, 0.54% of O, and the balance of Fe.

Embodiment 9

The method for preparing ferrovanadium alloys based on aluminothermic self-propagating gradient reduction and slag washing refining specially comprises the following steps:

(1) Aluminothermic self-propagating gradient reduction

Preparing the raw materials in mass ratio of the raw materials of $V_2O_5$, $Fe_2O_3$ powder, aluminium powder and a slag former CaO being 1.0 to 0.49 to 0.66 to 0.91, wherein the particle size meets that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; dividing the materials into 7 batches, wherein the aluminium proportioning amount of each batch of the materials is gradually 1.20, 1.1, 1.0, 0.95, 0.925, 0.90, 0.875 and 0.85 time of the theoretical stoichiometric ratio of the aluminothermic self-propagating reaction, the total aluminium proportioning amount of the raw materials is 0.94 times of the theoretical stoichiometric ratio of the aluminothermic self-propagating reaction, and the weight of the first batch of the materials is 22.2% of that of the total materials; adding the first batch of the materials to a reaction furnace, pouring the first batch of materials into the reaction furnace, performing igniting with magnesium powder from the top of the materials to initiate the self-propagating reaction, and sequentially adding other batches of the materials till complete reaction to obtain high-temperature melt;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1700° C., and the heat preserving time is 5 min;

(3) Removing 90% of upper-layer aluminium oxide based melt slags, jetting refining slags into the lower layer alloy melt, and performing stirring and slag washing refining, wherein the refining slags consist of the components in mass ratio of 25% of $CaF_2$ and 75% of CaO, and the control parameters are as follows: the addition amount of the refining slags is 7% of total raw materials, argon gas with purity being greater than or equal to 99.95% is used as carrier gas, the eccentric stirring speed is 150 rpm, the eccentric rate is 0.38, the refining temperature is 1700° C., and the refining time is 30 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 62.4% of V, 0.2% of Si, 0.53% of Al, 0.38% of O, and the balance of Fe.

Embodiment 10

The method for preparing ferrovanadium alloys based on aluminothermic self-propagating gradient reduction and slag washing refining specially comprises the following steps:

(1) Aluminothermic self-propagating gradient reduction

Preparing the raw materials in mass ratio of the raw materials of $V_2O_3$, $Fe_2O_3$ powder, aluminium powder and a slag former CaO being 1.0 to 0.54 to 0.69 to 1.21, wherein the particle size meets that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; uniformly mixing the raw materials of the $V_2O_3$, the $Fe_2O_3$ powder and the slag former to obtain a mixture, adding the mixture into a continuous mixer at an even velocity, adding the aluminium powder into the continuous mixer at a gradiently decreased velocity at the same time, and continuously introducing the uniformly mixed materials into the reaction furnace for the aluminothermic self-propagating reaction, wherein the entire material mixing process and the entire reaction process are performed continuously until all materials react completely to obtain the high-temperature melt, the aluminium proportioning amount of continuous materials introduced into the reaction furnace is gradiently reduced from 1.18 times to 0.69 times of the theoretical stoichiometric ratio of the aluminothermic self-propagating reaction, the number a of gradient changes is 0.0035, the number of gradient changes of the aluminium proportioning amount in the entire process is 140 times, and the total aluminium proportioning amount of the raw materials is 0.97 times of the theoretical stoichiometric ratio of the aluminothermic self-propagating reaction;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1750° C., and the heat preserving time is 10 min;

(3) Removing 90% of upper-layer aluminium oxide based melt slags, jetting refining slags into the lower layer alloy melt, and performing stirring and slag washing refining, wherein the refining slags consist of the components in mass ratio of 10% of $CaF_2$, 85% of CaO and 5% of $Na_2O$, and the control parameters are as follows: the addition amount of the refining slags is 5% of total raw materials, argon gas with purity being greater than or equal to 99.95% is used as carrier gas, the eccentric stirring speed is 100 rpm, the eccentric rate is 0.32, the refining temperature is 1750° C., and the refining time is 20 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 60.8% of V, 0.6% of Si, 0.66% of Al, 0.58% of O, and the balance of Fe.

Embodiment 11

The method for preparing ferrovanadium alloys based on aluminothermic self-propagating gradient reduction and slag washing refining specially comprises the following steps:

(1) Aluminothermic self-propagating gradient reduction

Preparing the raw materials in mass ratio of the raw materials of $V_2O_3$, $Fe_2O_3$ powder, aluminium powder and a slag former CaO being 1.0 to 0.61 to 0.71 to 1.34, wherein the particle size meets that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; uniformly mixing the raw materials of the $V_2O_3$, the $Fe_2O_3$ powder and the slag former to obtain a mixture, adding the mixture into a continuous mixer at an even velocity, adding the aluminium powder into the continuous mixer at a gradiently decreased velocity at the same time, and continuously introducing the uniformly mixed materials into the reaction furnace for the aluminothermic self-propagating reaction, wherein the entire material mixing process and the entire reaction process are performed continuously until all materials react completely to obtain the high-temperature melt, the aluminium proportioning amount of continuous materials introduced into the reaction furnace is gradiently reduced from 1.28 times to 0.68 times of the theoretical stoichiometric ratio of the aluminothermic self-propagating reaction, the number a of gradient changes is 0.0025, the number of gradient changes of the aluminium proportioning amount in the entire process is 240 times, and the total aluminium proportioning amount of the raw materials is 0.96 times of the theoretical stoichiometric ratio of the aluminothermic self-propagating reaction;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1700° C., and the heat preserving time is 10 min;

(3) Removing 90% of upper-layer aluminium oxide based melt slags, jetting refining slags into the lower layer alloy melt, and performing stirring and slag washing refining, wherein the refining slags consist of the components in mass ratio of 10% of $CaF_2$, 80% of CaO and 10% of $Na_2O$, and the control parameters are as follows: the addition amount of the refining slags is 4% of total raw materials, argon gas with purity being greater than or equal to 99.95% is used as carrier gas, the eccentric stirring speed is 100 rpm, the eccentric rate is 0.35, the refining temperature is 1700° C., and the refining time is 20 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 59.2% of V, 0.7% of Si, 0.56% of Al, 0.44% of O, and the balance of Fe.

Embodiment 12

The method for preparing ferrovanadium alloys based on aluminothermic self-propagating gradient reduction and slag washing refining specially comprises the following steps:

(1) Aluminothermic self-propagating gradient reduction

Preparing the raw materials in mass ratio of the raw materials of $V_2O_3$, $Fe_2O_3$ powder, aluminium powder and a slag former CaO being 1.0 to 0.72 to 0.74 to 1.48, wherein the particle size meets that the particle size of the vanadium oxide is smaller than or equal to 5mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; uniformly mixing the raw materials of the $V_2O_3$, the $Fe_2O_3$ powder and the slag former to obtain a mixture, adding the mixture into a continuous mixer at an even velocity, adding the aluminium powder into the continuous mixer at a gradiently decreased velocity at the same time, and continuously introducing the uniformly mixed materials into the reaction furnace for the aluminothermic self-propagating reaction, wherein the entire material mixing process and the entire reaction process are performed continuously until all materials react completely to obtain the high-temperature melt, the aluminium proportioning amount of continuous materials introduced into the reaction furnace is gradiently reduced from 1.23 times to 0.75 times of the theoretical stoichiometric ratio of the aluminothermic self-propagating reaction, the number a of gradient changes is 0.0015, the number of gradient changes of the aluminium proportioning amount in the entire process is 320 times, and the total aluminium proportioning amount of the raw materials is 0.94 times of the theoretical stoichiometric ratio of the aluminothermic self-propagating reaction;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1700° C., and the heat preserving time is 10 min;

(3) Removing 90% of upper-layer aluminium oxide based melt slags, jetting refining slags into the lower layer alloy melt, and performing stirring and slag washing refining, wherein the refining slags consist of the components in mass ratio of 20% of $CaF_2$, 75% of CaO and 5% of $Na_2O$, and the control parameters are as follows: the addition amount of the refining slags is 8% of total raw materials, argon gas with purity being greater than or equal to 99.95% is used as carrier gas, the eccentric stirring speed is 100 rpm, the eccentric rate is 0.4, the refining temperature is 1700° C., and the refining time is 30 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 56.8% of V, 0.6% of Si, 0.5% of Al, 0.28% of O, and the balance of Fe.

Embodiment 13

The method for preparing ferrovanadium alloys based on aluminothermic self-propagating gradient reduction and slag washing refining specially comprises the following steps:

(1) Aluminothermic self-propagating gradient reduction

Preparing the raw materials in mass ratio of the raw materials of $V_2O_3$, $Fe_2O_3$ powder, aluminium powder and a slag former CaO being 1.0 to 0.2 to 0.56 to 0.85, wherein the particle size meets that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; dividing the materials into 5 batches, wherein the aluminium proportioning amount of each batch of the materials is gradually 1.20, 1.05, 1.0, 0.90 and 0.85 time of the theoretical stoichiometric ratio of the aluminothermic self-propagating reaction, the total aluminium proportioning amount of the raw materials is 0.98 times of the theoretical stoichiometric ratio of the aluminothermic self-propagating reaction, and the weight of the first batch of the materials is 20% of that of the total materials; adding the first batch of the materials to a reaction furnace, pouring the first batch of materials into the reaction furnace, performing igniting with magnesium powder from the top of the materials to initiate the self-propagating reaction, and sequentially adding other batches of the materials till complete reaction to obtain high-temperature melt;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1800° C., and the heat preserving time is 15 min;

(3) Removing 90% of upper-layer aluminium oxide based melt slags, jetting refining slags into the lower layer alloy melt, and performing stirring and slag washing refining, wherein the refining slags consist of the components in mass ratio of 10% of $CaF_2$ and 90% of CaO, and the control parameters are as follows: the addition amount of the refining slags is 2% of total raw materials, argon gas with purity being greater than or equal to 99.95% is used as carrier gas, the eccentric stirring speed is 50 rpm, the eccentric rate is 0.4, the refining temperature is 1800° C., and the refining time is 10 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 79.2% of V, 0.2% of Si, 0.62% of Al, 0.6% of O, and the balance of Fe.

Embodiment 14

The method for preparing ferrovanadium alloys based on aluminothermic self-propagating gradient reduction and slag washing refining specially comprises the following steps:

(1) Aluminothermic self-propagating gradient reduction

Preparing the raw materials in mass ratio of the raw materials of $V_2O_5$, $Fe_2O_3$ powder, aluminium powder and a slag former CaO being 1.0 to 0.26 to 0.57 to 0.88, wherein the particle size meets that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; dividing the materials into 6 batches, wherein the aluminium proportioning amount of each batch of the materials is gradually 1.20, 1.1, 0.95, 0.90, 0.85 and 0.80 time of the theoretical stoichiometric ratio of the aluminothermic self-propagating reaction, the total aluminium proportioning amount of the raw materials is 0.95 times of the theoretical stoichiometric ratio of the aluminothermic self-propagating reaction, and the weight of the first batch of the materials is 28.6% of that of the total materials; adding the first batch of the materials to a reaction furnace, pouring the first batch of materials into the reaction furnace, performing igniting with magnesium powder from the top of the materials to initiate the self-propagating reaction, and sequentially adding other batches of the materials till complete reaction to obtain high-temperature melt;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1750° C., and the heat preserving time is 10 min;

(3) Removing 90% of upper-layer aluminium oxide based melt slags, jetting refining slags into the lower layer alloy melt, and performing stirring and slag washing refining, wherein the refining slags consist of the components in mass ratio of 20% of $CaF_2$ and 80% of CaO, and the control parameters are as follows: the addition amount of the refining slags is 5% of total raw materials, argon gas with purity being greater than or equal to 99.95% is used as carrier gas, the eccentric stirring speed is 100 rpm, the eccentric rate is 0.4, the refining temperature is 1750° C., and the refining time is 20 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 78.5% of V, 0.3% of Si, 0.58% of Al, 0.58% of O, and the balance of Fe.

Embodiment 15

The method for preparing ferrovanadium alloys based on aluminothermic self-propagating gradient reduction and slag washing refining specially comprises the following steps:

(1) Aluminothermic self-propagating gradient reduction

Preparing the raw materials in mass ratio of the raw materials of $V_2O_5$, $Fe_2O_3$ powder, aluminium powder and a slag former CaO being 1.0 to 0.27 to 0.58 to 0.96, wherein the particle size meets that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; dividing the materials into 7 batches, wherein the aluminium proportioning amount of each batch of the materials is gradually 1.20, 1.1, 1.0, 0.95, 0.925, 0.90 and 0.85 time of the theoretical stoichiometric ratio of the aluminothermic self-propagating reaction, the total aluminium proportioning amount of the raw materials is 0.94 times of the theoretical stoichiometric ratio of the aluminothermic self-propagating reaction, and the weight of the first batch of the materials is 22.2% of that of the total materials; adding the first batch of the materials to a reaction furnace, pouring the first batch of materials into the reaction furnace, performing igniting with magnesium powder from the top of the materials to initiate the self-propagating reaction, and sequentially adding other batches of the materials till complete reaction to obtain high-temperature melt;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1700° C., and the heat preserving time is 5 min;

(3) Removing 90% of upper-layer aluminium oxide based melt slags, jetting refining slags into the lower layer alloy melt, and performing stirring and slag washing refining, wherein the refining slags consist of the components in mass ratio of 25% of $CaF_2$ and 75% of CaO, and the control parameters are as follows: the addition amount of the refining slags is 7% of total raw materials, argon gas with purity being greater than or equal to 99.95% is used as carrier gas, the eccentric stirring speed is 150 rpm, the eccentric rate is 0.34, the refining temperature is 1700° C., and the refining time is 30 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 76.5% of V, 0.2% of Si, 0.49% of Al, 0.26% of O, and the balance of Fe.

Embodiment 16

The method for preparing ferrovanadium alloys based on aluminothermic self-propagating gradient reduction and slag washing refining specially comprises the following steps:

(1) Aluminothermic self-propagating gradient reduction

Preparing the raw materials in mass ratio of the raw materials of $V_2O_5$, $Fe_2O_3$ powder, aluminium powder and a slag former CaO being 1.0 to 0.29 to 0.59 to 1.06, wherein the particle size meets that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; uniformly mixing the raw materials of the $V_2O_5$, the $Fe_2O_3$ powder and the slag former to obtain a mixture, adding the mixture into a continuous mixer at an even velocity, adding the aluminium powder into the continuous mixer at a gradiently decreased velocity at the same time, and continuously introducing the uniformly mixed materials into the reaction furnace for the aluminothermic self-propagating reaction, wherein the entire material mixing process and the entire reaction process are performed continuously until all materials react completely to obtain the high-temperature melt, the aluminium proportioning amount of continuous materials introduced into the reaction furnace is gradiently reduced from 1.29 times to 0.69 times of the theoretical stoichiometric ratio of the aluminothermic self-propagating reaction, the number a of gradient changes is 0.003, the number of gradient changes of the aluminium proportioning amount in the entire process is 200 times, and the total aluminium proportioning amount of the raw materials is 0.97 times of the theoretical stoichiometric ratio of the aluminothermic self-propagating reaction;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1750° C., and the heat preserving time is 10 min;

(3) Removing 90% of upper-layer aluminium oxide based melt slags, jetting refining slags into the lower layer alloy melt, and performing stirring and slag washing refining, wherein the refining slags consist of the components in mass ratio of 10% of $CaF_2$, 85% of CaO and 5% of $Na_2O$, and the control parameters are as follows: the addition amount of the refining slags is 5% of total raw materials, argon gas with purity being greater than or equal to 99.95% is used as carrier gas, the eccentric stirring speed is 100 rpm, the eccentric rate is 0.2, the refining temperature is 1750° C., and the refining time is 20 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 75.8% of V, 0.6% of Si, 0.58% of Al, 0.58% of O, and the balance of Fe.

Embodiment 17

The method for preparing ferrovanadium alloys based on aluminothermic self-propagating gradient reduction and slag washing refining specially comprises the following steps:

(1) Aluminothermic self-propagating gradient reduction

Preparing the raw materials in mass ratio of the raw materials of $V_2O_5$, $Fe_2O_3$ powder, aluminium powder and a slag former CaO being 1.0 to 0.3 to 0.6 to 1.2, wherein the particle size meets that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; uniformly mixing the raw materials of the $V_2O_5$, the $Fe_2O_3$ powder and the slag former to obtain a mixture, adding the mixture into a continuous mixer at an even velocity, adding the aluminium powder into the continuous mixer at a gradiently decreased velocity at the same time, and continuously introducing the uniformly mixed materials into the reaction furnace for the aluminothermic self-propagating reaction, wherein the entire material mixing process and the entire reaction process are performed continuously until all materials react completely to obtain the high-temperature melt, the aluminium proportioning amount of continuous materials introduced into the reaction furnace is gradiently reduced from 1.21 times to 0.74 times of the theoretical stoichiometric ratio of the aluminothermic self-propagating reaction, the number a of gradient changes is 0.002, the number of gradient changes of the aluminium proportioning amount in the entire process is 235 times, and the total aluminium proportioning amount of the raw materials is 0.95 times of the theoretical stoichiometric ratio of the aluminothermic self-propagating reaction;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1700° C., and the heat preserving time is 10 min;

(3) Removing 90% of upper-layer aluminium oxide based melt slags, jetting refining slags into the lower layer alloy melt, and performing stirring and slag washing refining, wherein the refining slags consist of the components in mass ratio of 10% of $CaF_2$, 80% of CaO and 10% of $Na_2O$, and the control parameters are as follows: the addition amount of the refining slags is 4% of total raw materials, argon gas with purity being greater than or equal to 99.95% is used as carrier gas, the eccentric stirring speed is 100 rpm, the eccentric rate is 0.3, the refining temperature is 1700° C., and the refining time is 20 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 74.3% of V, 0.7% of Si, 0.47% of Al, 0.52% of O, and the balance of Fe.

Embodiment 18

The method for preparing ferrovanadium alloys based on aluminothermic self-propagating gradient reduction and slag washing refining specially comprises the following steps:

(1) Aluminothermic self-propagating gradient reduction

Preparing the raw materials in mass ratio of the raw materials of $V_2O_5$, $Fe_2O_3$ powder, aluminium powder and a slag former CaO being 1.0 to 0.32 to 0.6 to 1.22, wherein the particle size meets that the particle size of the vanadium oxide is smaller than or equal to 5 mm, the particle size of $Fe_2O_3$ is smaller than or equal to 0.2 mm, the particle size of the aluminium powder is smaller than or equal to 5 mm, and the particle size of the slag former is smaller than or equal to 0.2 mm; uniformly mixing the raw materials of the $V_2O_5$, the $Fe_2O_3$ powder and the slag former to obtain a mixture, adding the mixture into a continuous mixer at an even velocity, adding the aluminium powder into the continuous mixer at a gradiently decreased velocity at the same time, and continuously introducing the uniformly mixed materials into the reaction furnace for the aluminothermic self-propagating reaction, wherein the entire material mixing process and the entire reaction process are performed continuously until all materials react completely to obtain the high-temperature melt, the aluminium proportioning amount of continuous materials introduced into the reaction furnace is gradiently reduced from 1.16 times to 0.78 times of the theoretical stoichiometric ratio of the aluminothermic self-propagating reaction, the number a of gradient changes is 0.001, the number of gradient changes of the aluminium proportioning amount in the entire process is 380 times, and the total aluminium proportioning amount of the raw materials is 0.94 times of the theoretical stoichiometric ratio of the aluminothermic self-propagating reaction;

(2) Performing heat preserving and smelting on the high-temperature melt through electromagnetic induction heating to realize metal-slag separation to obtain an upper layer alumina-based slag and a lower layer alloy melt, wherein the control parameters are as follows: the electromagnetic induction frequency is greater than or equal to 1000 Hz, the smelting temperature is 1700° C., and the heat preserving time is 15 min;

(3) Removing 90% of upper-layer aluminium oxide based melt slags, jetting refining slags into the lower layer alloy melt, and performing stirring and slag washing refining, wherein the refining slags consist of the components in mass ratio of 20% of $CaF_2$, 75% of CaO and 5% of $Na_2O$, and the control parameters are as follows: the addition amount of the refining slags is 8% of total raw materials, argon gas with purity being greater than or equal to 99.95% is used as carrier gas, the eccentric stirring speed is 100 rpm, the eccentric rate is 0.31, the refining temperature is 1700° C., and the refining time is 30 min; and (4) Cooling the refined high-temperature melt to room temperature, and removing the upper layer smelting slag to obtain the ferrovanadium alloys.

Furthermore, the prepared ferrovanadium alloys in the embodiment consist of the following chemical components in percentages by mass: 71.4% of V, 0.6% of Si, 0.42% of Al, 0.25% of O, and the balance of Fe.

It should be understood that improvements or transformations can be made based on the above description by ordinary technicians in the art, and all of these improvements and transformations shall fall within the scope of protection claimed in the present invention.

What is claimed is:

1. A method for preparing ferrovanadium alloys based on aluminothermic self-propagating gradient reduction and slag washing refining, comprising the following steps:

(1) performing the aluminothermic self-propagating gradient reduction in one of the following two manners:

a first manner: dividing raw materials of vanadium oxide, $Fe_2O_3$ powder, aluminium powder and a slag former into 5-8 batches, pouring a first batch of the raw materials into a reaction furnace, igniting magnesium powder from a top of the raw materials to initiate an aluminothermic self-propagating reaction, and sequentially adding other batches of the raw materials until reaction is completed to obtain a melt, wherein an aluminium proportioning amount of each batch of the raw materials is reduced in a gradient manner from 1.15-1.35 times to 0.85-0.65 times a theoretical stoichiometric ratio of the aluminothermic self-propagating reaction, and a total aluminium proportioning amount of the raw materials is 0.94-1.00 times the theoretical stoichiometric ratio of the aluminothermic self-propagating reaction;

a second manner: uniformly mixing raw materials of the vanadium oxide, the $Fe_2O_3$ powder and the slag former to obtain a mixture, adding the mixture into a continuous mixer at an even velocity, adding the aluminium powder into the continuous mixer at a velocity decreasing in a gradient manner at the same time as adding the mixture into the continuous mixer, and continuously introducing uniformly mixed materials comprising the vanadium oxide, the $Fe_2O_3$ powder, the slag former and the aluminium powder into the reaction furnace for the aluminothermic self-propagating reaction, wherein an entire material mixing process and an entire reaction process are performed continuously until all materials react completely to obtain the melt, wherein the aluminium proportioning amount of the continuous raw materials introduced into the reaction furnace is gradiently reduced from 1.15-1.35 times to 0.85-0.65 times the theoretical stoichiometric ratio of the aluminothermic self-propagating reaction, wherein a number n of gradient changes of the aluminium proportioning amount in the entire process satisfies a relational expression: $n=(b-c)/a$, wherein b represents a highest aluminium proportioning amount, c represents a lowest aluminium proportioning amount, a represents a gradient change coefficient of the aluminium proportioning amount, and a is greater than 0 and smaller than or equal to 0.04, and the total aluminium proportioning amount of the raw materials is 0.094-1.00 times the theoretical stoichiometric ratio of the aluminothermic self-propagating reaction;

(2) performing heat preservation and smelting of the melt through electromagnetic induction heating to obtain an upper layer alumina-based slag and a lower layer alloy melt;

(3) jetting refinement slags into the lower layer alloy melt, and performing stirring and slag washing refinement; and (4) cooling the refined high temperature melt to room temperature, and removing an upper layer smelting slag to obtain the ferrovanadium alloys.

2. The method of claim 1, wherein a mass ratio of the raw materials of the vanadium oxide to the $Fe_2O_3$ powder to the aluminium powder to the slag former in step (1) is 1.0:(0.2-1.49):(0.56-1.00):(0.82-1.95), and particle sizes thereof respectively meet the following conditions: a particle size of the vanadium oxide is smaller than or equal to 5 mm, a particle size of the $Fe_2O_3$ is smaller than or equal to 0.2 mm, a particle size of the aluminium powder is smaller than or equal to 5 mm, and a particle size of the slag former is smaller than or equal to 0.2 mm.

3. The method of claim 1, wherein in step (1), a weight of the first batch of the raw materials is 10-30% of a total weight of the raw materials.

4. The method of claim 1, wherein control parameters of the heat preservation and smelting in step (2) are as follows: an electromagnetic induction frequency is greater than or equal to 1000 Hz, a smelting temperature is 1700-1800° C., and a heat preserving time is 5-15 min.

5. The method of claim 1, wherein the refinement slags in step (3) is one of the following two types: (1) 10-25% of $CaF_2$ and a balance of CaO by mass; and (2) 10-25% of $CaF_2$, 5-10% of $Na_2O$ and a balance of CaO by mass.

6. The method of claim 1, wherein control parameters of the stirring and slag washing refinements in step (3) are as follows: an eccentric stirring is adopted, an eccentricity ratio is 0.2-0.4, an addition amount of the refinement slags is 2-8% of total raw materials and inert gas with purity being greater than or equal to 99.95% is used as carrier gas, a stirring speed is 50-150 rpm, a refining temperature is 1700-1800° C., and a refining time is 10-30 min.

7. The method of claim 1, wherein the ferrovanadium alloys comprise chemical components in percentage by mass of 35.0-80.0% of V, Al being smaller than or equal to 1.5%, Si being smaller than or equal to 1.0%, O being smaller than or equal to 1.0%, and a balance of Fe.

* * * * *